US006965199B2

(12) United States Patent
Stoner et al.

(10) Patent No.: US 6,965,199 B2
(45) Date of Patent: Nov. 15, 2005

(54) COATED ELECTRODE WITH ENHANCED ELECTRON EMISSION AND IGNITION CHARACTERISTICS

(75) Inventors: Brian R. Stoner, Chapel Hill, NC (US); Otto Z. Zhou, Chapel Hill, NC (US); Rachel A. Rosen, Chapel Hill, NC (US); William H. Simendinger, III, Raleigh, NC (US); Chris Debbaut, Hood River, OR (US)

(73) Assignees: The University of North Carolina at Chapel Hill, Chapel Hill, NC (US); Tyco Electronics Corporation, Middletown, PA (US)

( * ) Notice: Subject to any disclaimer, the term of this patent is extended or adjusted under 35 U.S.C. 154(b) by 37 days.

(21) Appl. No.: 09/817,164

(22) Filed: Mar. 27, 2001

(65) Prior Publication Data

US 2002/0140336 A1 Oct. 3, 2002

(51) Int. Cl.[7] ..... H01J 17/06; H01J 17/48

(52) U.S. Cl. ..... 313/574; 313/491; 313/311; 361/120

(58) Field of Search ..... 313/309–311, 567, 313/574, 491, 336, 351, 231.11, 231.41, 346 DC, 346 R, 495, 496; 361/118–120; 445/24; 379/399

(56) References Cited

U.S. PATENT DOCUMENTS 4,707,762 A * 11/1987 Yapoujian ..... 361/124
5,416,663 A 5/1995 Atkins
5,495,143 A * 2/1996 Lengyel et al. ..... 313/574
5,513,059 A 4/1996 Atkins
5,557,250 A * 9/1996 Debbaut et al. ..... 338/21
5,557,672 A * 9/1996 Perry et al. ..... 379/399.01
5,841,836 A * 11/1998 Dunn et al. ..... 379/26.01
5,866,975 A * 2/1999 Gartner et al. ..... 313/346 DC
5,953,194 A 9/1999 Atkins
6,239,547 B1 * 5/2001 Uemura et al. ..... 313/495
6,250,984 B1 * 6/2001 Jin et al. ..... 445/51
6,277,318 B1 8/2001 Bower et al.
6,280,697 B1 8/2001 Zhou et al.

(Continued)

FOREIGN PATENT DOCUMENTS

JP 57-96453 * 6/1982 ..... H01J/61/67
JP 57096453 A * 6/1982 ..... H01J/61/067
JP 2004-18986 A * 1/2004 ..... C23C/16/26

OTHER PUBLICATIONS

Fan, Shousham, et al., "Self–Oriented Regular Arrays of Carbon Nanotubes and Their Field Emission Properties", SCIENCE, vol. 283, Jan. 22, 1999, pp. 512–514.

(Continued)

*Primary Examiner*—Karabi Guharay
(74) *Attorney, Agent, or Firm*—Burns, Doane, Swecker & Mathis, L.L.P.

(57) ABSTRACT

An improved electrode capable of smaller variances and mean breakdown voltage, increased breakdown reliability, smaller electron emission turn-on requirements, and stable electron emissions capable of high current densities include a first electrode material, an adhesion-promoting layer disposed on at least one surface of the first electrode material, and a nanostructure-containing material disposed on at least a portion of the adhesion promoting layer. An improved gas discharge device is provided incorporating an electrode formed as described above. An improved circuit incorporating an improved gas discharge tube device as set forth above is also provided. Further, an improved telecommunications network, incorporating an improved gas discharge tube device as set forth above can also be provided. An improved lighting device is also provided incorporating an electrode constructed as described above.

18 Claims, 8 Drawing Sheets

U.S. PATENT DOCUMENTS

| | | | | |
|---|---|---|---|---|
| 6,334,939 | B1 | 1/2002 | Zhou et al. | |
| 6,339,281 | B2 * | 1/2002 | Lee et al. | 313/309 |
| 6,417,606 | B1 * | 7/2002 | Nakamoto et al. | 313/336 |
| 6,448,701 | B1 * | 9/2002 | Hsu | 313/309 |
| 6,456,691 | B2 | 9/2002 | Takahashi et al. | |
| 6,459,767 | B1 | 10/2002 | Boyer | |
| 2002/0110996 | A1 | 8/2002 | Yaniv et al. | |
| 2002/0121856 | A1 * | 9/2002 | Tsai | 313/491 |
| 2002/0171357 | A1 | 11/2002 | Sun et al. | |

OTHER PUBLICATIONS

Gao, Bo, et al., "Fabrication and Electron Filed Emission Properties of Carbon Nanotube Films by Electrophoretic Deposition" Advanced Materials 2001, vol. 13, No. 23, Dec. 3, 2001, pp. 1770–1773.

U.S. Appl. No. 09/296,572 filed Apr. 22, 2992 entitled "Device Comprising Carbon Nanotube Field Emitter Structure and Process for Forming Device." to Bower et al.

U.S. Appl. No. 09/259,307, Zhou et al., filed Mar. 1, 1999.

U.S. Appl. No. 09/376,457, Bower et al., filed Aug. 18, 1999.

U.S. Appl. No. 09/594,844, Zhou et al., filed Jun. 15, 2000.

U.S. Appl. No. 09/679,303, Zhou et al., filed Oct. 6, 2000.

U.S. Appl. No. 09/351,537, Bower et al., filed Jul. 1, 1999.

* cited by examiner

COATED ELECTRODE WITH ENHANCED ELECTRON EMISSION AND IGNITION CHARACTERISTICS

STATEMENT REGARDING FEDERALLY SPONSORED RESEARCH AND DEVELOPMENT

At least some aspects of this invention were made with Government support under contract no. N00014-98-1-0597. The Government may have certain rights in this invention.

FIELD OF THE INVENTION

The present invention relates to an improved electrode construction and devices including such electrodes. More particularly, the invention relates to an electrode incorporating a nanostructured material, and devices including such electrodes.

BACKGROUND OF THE INVENTION

In the description that follows references are made to certain compounds, devices and methods. These references should not necessarily be construed as an admission that such compounds, devices and methods qualify as prior art under the applicable statutory provisions.

The term "nano-structured" or "nanostructure" material is used by those familiar with the art to designate materials including nanoparticles with a particle size or less than 100 nm, nanotubes (e.g.—carbon nanotubes), non-carbon nanotubes, nanorods or nanowires (e.g.—Si nanowires with a diameter of approximately 1–100 nm). These types of materials have been shown to exhibit certain properties that have raised interest in a variety of applications.

U.S. Pat. No. 6,280,697 entitled "Nanotube-Based High Energy Material and Method", the disclosure of which is incorporated herein by reference, in its entirety, discloses the fabrication of carbon-based nanotube materials and their use as a battery electrode material.

U.S. Pat. No. 6,277,318 entitled "Method for Fabrication of Patterned Carbon Nanotube Films", the disclosure of which is incorporated herein by reference, in its entirety, discloses a method of fabricating adherent, patterned carbon nanotube films onto a substrate.

U.S. Patent No. 6,334,939 entitled "Nanoscructure-Based High Energy Material and Method", the disclosure of which is incorporated herein by reference, in its entirety, discloses a nanostructure material having an intercalated alkali metal. Such materials are described as being useful in certain battery applications.

(Ser. No. 09/351,537 entitled "Device Comprising Thin Film Carbon Nanotube Electron Field Emitter Structure") the disclosure of which is incorporated herein by reference, in its entirety, discloses a carbon nanotube-based electron emitter structure.

Gas discharge tubes are devices that typically comprise parallel electrodes in a sealed vacuum chamber containing a noble gas, or mixture of noble gases, at a particular pressure. Gas tubes are designed to be insulators under normal voltage and current conditions. However, under large transient voltages, such as from lightning, a discharge is formed between the electrodes, causing a plasma breakdown of the noble gas(es) inside the chamber. In the plasma state, the gas tube becomes a conductor, which is designed to shunt or short circuit the system in which it is incorporated, thereby protecting other components of the system from damage caused by the over voltage.

Gas discharge tubes are robust, moderately expensive, and have a relatively small shunt capacitance, so bandwidth of high-frequency circuits is not limited as much as by other solid state protectors. Moreover, gas discharge tubes can carry much higher currents than solid state protectors.

However, conventional gas discharge tubes posses certain disadvantages. Gas discharge tubes are unreliable in term of the "mean turn-on voltage", that is the voltage required to turn the device into a conductor can vary significantly from run to run (i.e.—repeated exposures to overvoltages).

Moreover, since a relatively high electric field is required to cause the plasma breakdown, the electrodes are typically provided with a very small separation distance. Small variations in the gap spacing can cause large variability in the breakdown voltage. Thus, manufacture of such devices must be carried out with great precision in order to avoid such variances.

Thus, it would be advantageous to provide an improved device which exhibits smaller variances in mean turn-on voltage, and can produce a high electric field with less dependence upon a precise, small electrode separation distance.

SUMMARY OF THE INVENTION

It is an object of the present invention to solve the problems of the art.

It is an object of the invention to provide and improved electrode construction providing smaller variances in mean breakdown voltage; increased breakdown reliability; smaller electron emission turn-on requirements; stable electron emission capable of high current density; and durability.

It is another object to provide an improved gas discharge device exhibiting smaller variances in mean breakdown voltage; increased breakdown reliability; smaller electron emission turn-on requirements; stable electron emission capable of high current density; durability; and reduced dependency on precise manufacture of small electrode separation distances.

It is another object of the invention to provide an improved circuit incorporating a gas discharge device constructed according to the principles of the present invention.

It is a further object of the invention to provide an improved telecommunications network incorporating a gas discharge device constructed according to the principles of the present invention.

It is yet another object of the present invention to provide an improved lighting device incorporating an improved electrode formed according to the principles of the present invention.

More particularly, in one aspect, the present invention is directed to an electrode comprising a first electrode material, an adhesion-promoting layer disposed on at least one surface of the first electrode material, and a nanostructure-containing material disposed on at least a portion of the adhesion-promoting layer.

According to another aspect, the present invention is directed to a gas discharge device comprising a sealed chamber containing at least one noble gas and a plurality of spaced electrodes, at least one electrode comprising a first electrode material, an adhesion-promoting layer disposed on at least one surface of the first electrode material, and a nanostructure-containing material disposed on at least a portion of the adhesion-promoting layer.

According to a further aspect, the present invention is directed to an improved circuit, optionally comprising at least one of an interface device box and central office switching gear, and comprising a gas discharge device of the present invention.

According to yet an other aspect, the present invention is directed to an improved telecommunications network comprising a discharge device of the present invention.

According to yet an other aspect, the present invention is directed to an improved lighting device comprising a first electrode material, an adhesion-promoting layer disposed on at least one surface of the first electrode material, and nanostructure-containing material disposed on at least a portion of the adhesion-promoting layer.

BRIEF DESCRIPTION OF THE DRAWING FIGURES

DETAILED DESCRIPTION OF THE INVENTION

According to the present invention, an electrode is formed, at least in part, by a nanostructure-containing material. Nanostructure-containing materials are characterized by having basic building blocks that are nanometer-sized in at least one direction. Examples of such basic building blocks include nanoparticles, cage-like fullerene molecules, carbon nanotubes, and silicon nanorods. These basic building blocks can be formed, for example, of carbon, silicon, germanium, aluminum, silicon oxide, germanium oxide, silicon carbide, boron, boron nitride, and boron carbide, etc., or a mixture of such materials.

According to a preferred embodiment of the present invention, the basic building block of the nanostructure-containing material is carbon nanotubes, preferably single-walled carbon nanotubes. These single-walled carbon nanotubes can be formed by what are now considered "conventional" techniques, such as laser ablation, arc-discharge, and chemical vapor deposition techniques. More specific details of such materials and their fabrication can be gleaned, for example, from U.S. Pat. No. 6,334,939 and U.S. Pat. No. 6,280,697 (Ser. No. 09/259,307).

Figure 3:
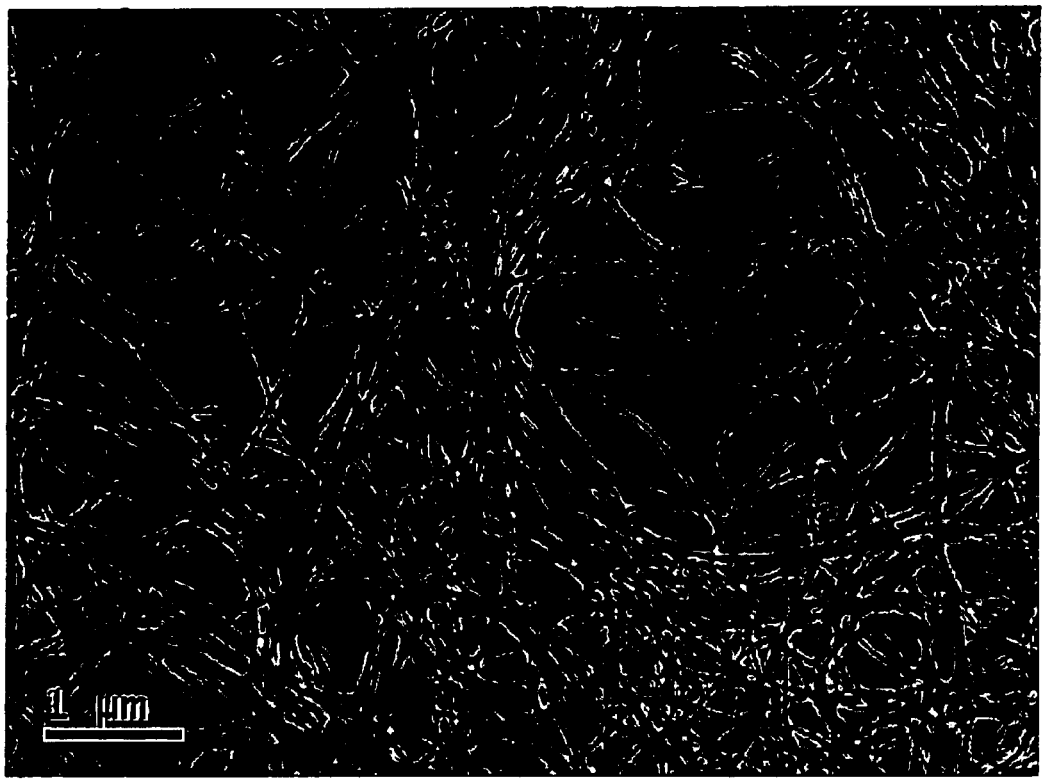
FIG. 3 is a transition electron microscope image of purified single-walled nanotube bundles.

According to a preferred embodiment, single-walled carbon nanotubes having a tube diameter of approximately 1–2 nm, with a bundle diameter of approximately 10–50 nm, were formed using a laser ablation technique. The single-walled carbon nanotubes recovered from laser ablation were then subjected to a suitable purification process. According to a preferred embodiment, the as-recovered material was first subject to reflux in a 20% $H_2O_2$ solution at 100° C. Then the material was filtered while being suspended in a methanol medium under ultrasonic agitation. The purified single-walled carbon nanotube material was then characterized by transmission electron microscopy and x-ray diffraction measurements. The purified materials were found to contain 80–90 volume % single-walled carbon nanotube bundles with a bundle diameter of 10–50 nm and an average nanotube diameter of approximately 1.4 nm. Impurities found in the material included nickel and cobalt catalysts, amorphous carbon and graphitic nanoparticles. FIG. 3 is a representative transmission electron microscopy micrograph of the purified single walled carbon nanotubes.

In addition to the above described processing steps, it is within the scope of the present invention that the purified materials can be subjected to further processing steps, such as ball milling or oxidation in an acid.

According to the present invention, an electrode is formed, at least in part, by the above-described materials. The electrode can be formed in any suitable manner, and possess any suitable geometry. The electrode may be formed entirely of the nanostructure-containing material of the present invention, or the electrode may comprise a substrate that is at least partially coated with a layer of nanostructure-containing material.

Figure 1:
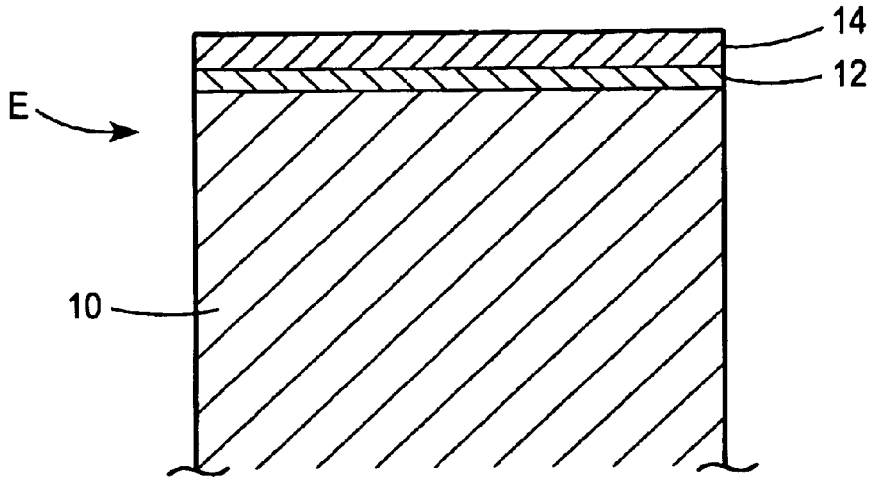
FIG. 1 is a schematic illustration of an improved electrode formed according to the principles of the present invention.
Figure 2:
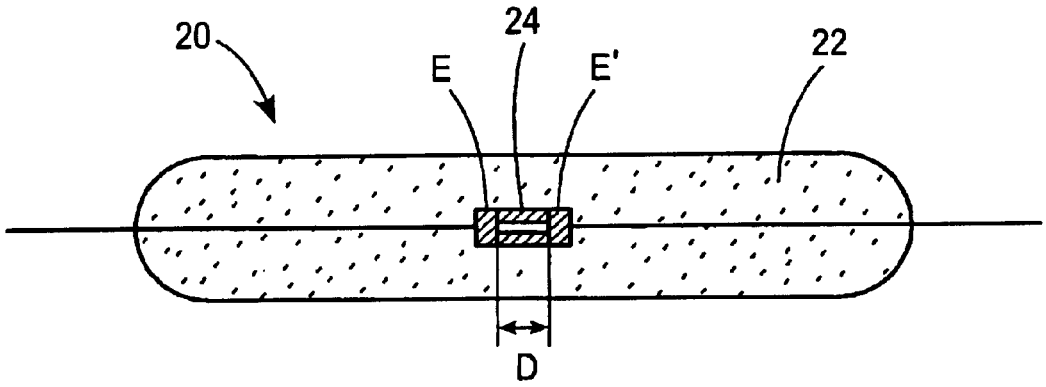
FIG. 2 is a schematic illustration of a gas discharge device formed according to the principles of the present invention.

FIG. 1 illustrates a preferred embodiment of an electrode formed according to the principles of the present invention. As illustrated in FIG. 1, the Electrode comprises a first base or substrate material 10, an adhesion-promoting layer 12 formed on at least one surface of the base material 10, and a layer of nanostructure-containing material 14 formed on at least a portion of the adhesion promoting layer 12.

As noted above, the base electrode material 10 can comprise suitable material, and have any suitable geometry. According to a preferred embodiment, the base electrode material 10 comprises molybdenum in the form of a ¾ inch diameter disk.

According to a preferred embodiment, the base electrode material 10 is provided with a thin layer of an adhesion-promoting material formed at least on one surface thereof. Preferably, the adhesion promoting layer 12 comprises a carbon-dissolving, carbide-forming, or low melting point material. Preferred carbon-dissolving materials include nickel, cobalt and iron. Preferred carbide-forming material include silicon, molybdenum, titanium, tantalum, tungsten, niobium, zirconium, vanadium, chromium, and hafnium. Preferred low melting point materials include aluminum, tin, cadmium, zinc and bismuth. The layer 12 can be deposited on the base material 10 by any suitable technique, such as ion sputtering or thermal evaporation. When a material having a relatively high melting point is used, such as platinum, ion sputtering is the preferred technique. When aluminum or iron are chosen as the adhesion-promoting layer material, thermal evaporation is the preferred technique. The adhesion promoting layer 12 can have any suitable thickness. According to a preferred embodiment, the thickness of the adhesion promoting layer 12 is on the order of 50 nm.

Next, a layer of nanostructure-containing material 14 is deposited on at least a portion of the adhesion-promoting layer 12. According to a preferred embodiment, the layer 14 is provided over the entire surface area of the adhesion-promoting layer 12. As previously noted, the layer 14 preferably comprises single-walled carbon nanotubes. The single-walled carbon nanotubes can be deposited by a variety of methods, including suspension or solution casting, spraying, spin coating, sputtering, screen printing, pulsed laser deposition or electrophoretic deposition. By way of example, the film can have a thickness on the order of 0.001 to 50 $\mu$m, and more particularly 0.1 to 10 $\mu$m. According to a preferred embodiment, the single-walled carbon nanotube layer is sprayed on the adhesion-promoting layer 12.

Preferably, once the base electrode material 10 has been provided with an adhesion-promoting layer 12 and a nanostructure-containing layer 14, the coated electrode E is then subjected to annealing which serves to cure the coatings, thereby increasing the reliability and durability of the coatings. The particular annealing conditions may vary depending on the various materials forming the electrode E. By way of example, illustrative embodiments of the present invention have been prepared by annealing the coated electrode E for 0.5 hours at $5\times10^{-6}$ torr vacuum at a temperature ranging from 650–1150° C.

According to a further aspect, the present invention provides an improved gas discharge device 20 which incorporates one or more electrodes E, E' formed as described above. In the illustrated embodiment, the gas discharge device 20 comprises a sealed chamber 22, containing one or more electrodes E, E' constructed according to the principles of the present invention. Typically, the sealed chamber contains one or more noble gases at a certain pressure. This pressure may vary in the range of, for example, 0.1–1,000 torr. The electrodes E, E' are spaced a predetermined distance D from each other. A ceramic spacer 24 may be used to create the proper separation distance D between the electrodes E, E'. In the illustrated embodiment, spacer 24 is cylindrical.

As previously noted, a single electrode of the gas discharge device 20 may be formed according to the principles of the present invention, and the opposing electrode may have a conventional construction. Such an arrangement represents a gas discharge device having a polar construction. A bi-polar gas discharge device can be fabricated by forming each of the plurality of spaced electrodes E, E' from the same construction according to the principles of the present invention. The separation distance D can vary according to the conditions within the tube, electrode materials, composition of the noble gases, etc. For purposes of illustration, an appropriate separation distance D is 1 mm for a bipolar construction.

As explained in more detail below, a gas discharge device 20 formed according to the principles of the present invention possesses several advantages over conventional devices. Namely, the gas discharge device 20 exhibits smaller variances and mean breakdown voltage, increased breakdown reliability, smaller electron emission turn-on voltage requirement, stable electron emission at high current densities, less dependence upon precise electrode separation distance, and overall improvements in reliability and durability.

In order to demonstrate the effectiveness of the present invention, exemplary embodiments were constructed and analyzed. The following discussion of these exemplary embodiments are for purposes of illustration, and should not be viewed as limiting the scope of the present invention.

Raw single-walled carbon nanotube materials were fabricated using a laser-ablation system. The raw materials were purified first by reflux in 20% $H_2O_2$ solution at 100° C., then filtered in methanol under the assistance of ultrasonic agitation. The filtered single-walled carbon nanotube materials were then dried under a $10^{-6}$ torr vacuum. The purified material was found to contain 80–90 volume % single-walled nanotube bundles, with a bundle diameter of 10–50 nm, and an average nanotube diameter of 1.4 nm. Impurities included nickel and cobalt catalyst, and graphitic nanoparticles.

Molybdenum electrodes in the form of ¾ inch diameter disks were then coated with a thin layer, having a thickness on the order of 50 nm, of an adhesion-promoting material. A first set of molybdenum electrodes were coated. A first electrode was provided with a coating of aluminum, a second electrode was coated with iron, and a third electrode was coated with platinum. These electrodes were then coated with a thin layer of single-walled carbon nanotube material. The first coated electrode was annealed for 0.5 hours at $5\times10^{-6}$ torr vacuum at 650° C. The second coated electrode was annealed for 0.5 hours at $5\times10^{-6}$ torr vacuum at 850° C. The third coated electrode was annealed for 0.5 hours at $5\times10^{-6}$ torr vacuum at 1150° C.

Next, a second set of electrodes were prepared. A fourth electrode was coated with aluminum, a fifth electrode was coated with iron, and a sixth electrode was coated with platinum. These electrodes were then coated within a thin layer of single-walled carbon nanotube material. The fourth, fifth and sixth coated electrodes were not subjected to annealing. Measurements were then taken on both the annealed and unannealed samples.

Electron field emission properties were then measured using the above described nanotube-coated electrode separated by a distance of approximately 500 microns from a parallel plain molybdenum electrode. In this arrangement, the nanotube-coated electrodes act as the cathode, and the plain molybdenum electrode acts as the anode. The above described electrodes were placed under a vacuum of $10^{-6}$ torr.

Bipolar gas discharge devices were also fabricated using the same coated electrodes as both the cathode and anode. The distance between the electrodes was fixed at approximately 1 mm by a ceramic spacer. The sealed chamber of the discharge device was filled with noble gases and sealed. The direct current breakdown voltage was then measured over 1000 voltage surges. For purposes of comparison, commercially available gas discharge tubes with the same electrode to electrode separation distance were also measured.

Electron field emission data was collected using the above-described parallel-plate configuration in which the nanotube-coated electrode operates as the cathode, and the plane molybdenum electrode acts as the anode. The fixed anode-cathode distance is 500 microns.

Figure 4:
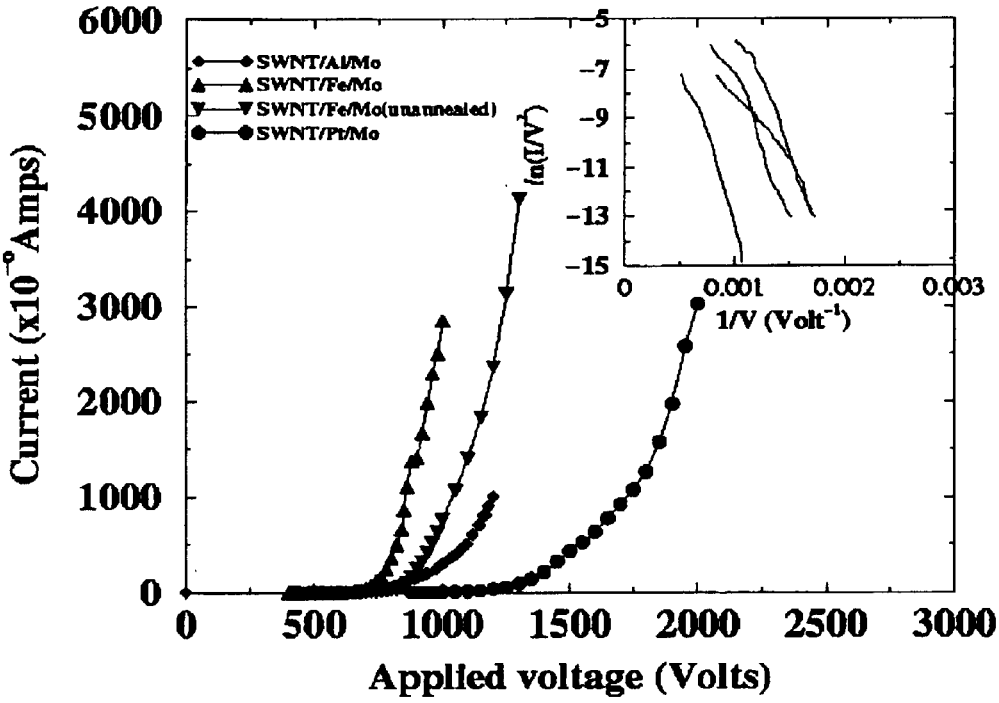
FIG. 4 is a plot of total field emission current vs. applied voltage measured for a device according to the present invention.

As illustrated in FIG. 4, the electron emission turn-on voltage, defined as the voltage for a total emission current of 1 $\mu$A collected over an emission area of 2.8 $cm^2$, is approximately 600V (1.2V/micron) for an annealed electrode having an iron adhesion-promoting layer as well as the annealed electrode having an aluminum adhesion-promoting layer. The emission turn-on voltage for the unannealed electrode having an iron adhesion-promoting layer was approximately 660V (1.3V/micron), while the emission turn-on voltage was approximately 1260V (2.5V/micron) for the annealed electrode having a platinum adhesion-promoting layer.

As shown in the inset of FIG. 4, the data was plotted as In ($I/V^2$) versus I/V (the "Fowler-Nordheim" plot). As illustrated in FIG. 4, the data, as plotted, is found to be essentially linear, thereby confirming that the nanotube-coated electrodes were field-emitting electrons under applied electrical fields.

The critical electrical field for a 1 mA/cm$^2$ current density was also measured and found to be 1.7V/micron for the annealed electrode having an iron adhesion-promoting layer, 2.3 V/micron for the annealed electrode having an aluminum adhesion-promoting layer, 2.0 V/micron for the unannealed electrode having an iron adhesion-promoting layer, and 3.0 V/micron for the annealed electrode having a platinum adhesion-promoting layer.

Figure 5:
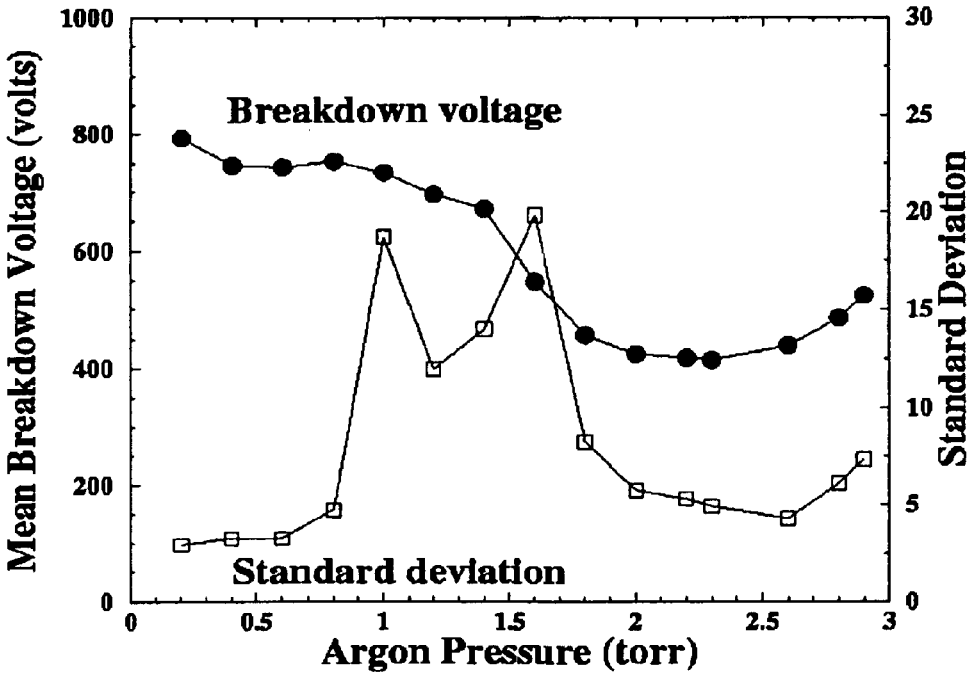
FIG. 5 is a plot of mean direct current breakdown voltage and standard deviation vs. argon pressure for a device according to the present invention.

Direct current breakdown voltage measurements were then taken for a bipolar gas discharge device comprising spaced molybdenum electrodes provided with an iron adhesion-promoting layer and a layer of single walled carbon nanotubes. Measurements were taken at different gas pressures within the device, and with different gas contents. The results are summarized in FIG. 5. The measurements were taken over 100 voltage surges performed at each argon pressure data point. As illustrated in FIG. 5, direct current breakdown voltage varies with the gas pressure within the sealed chamber. The most reliable breakdown behavior was observed at 0.5 torr using an argon gas. The breakdown voltage was lower at higher argon pressures, and was observed to be even lower when a small amount of neon gas was added.

Figure 6:
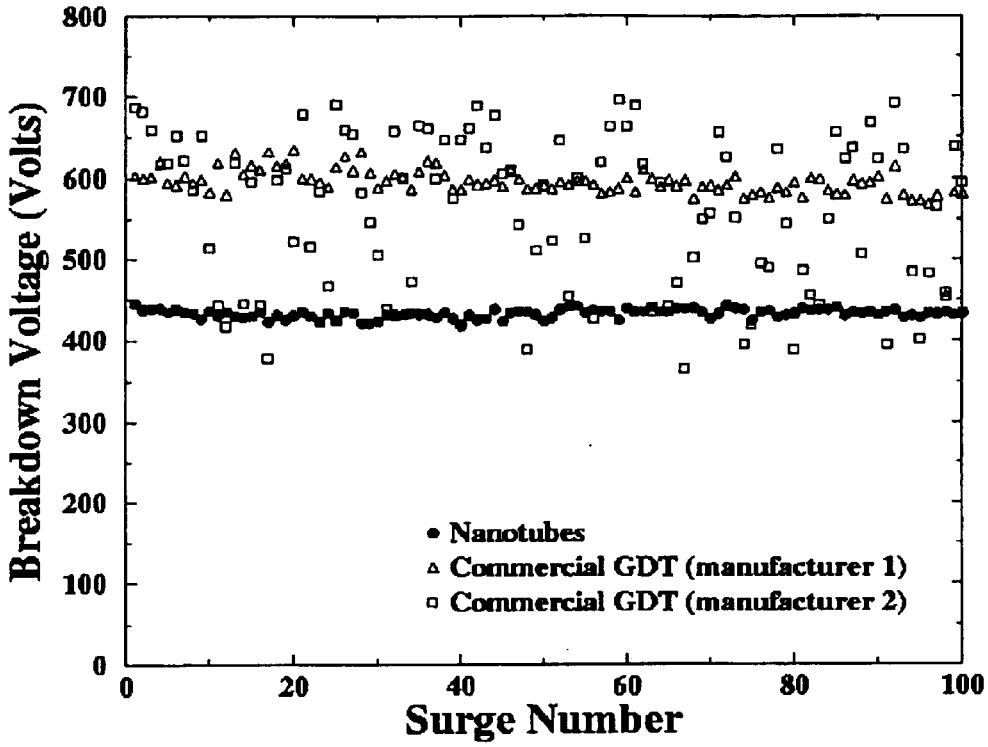
FIG. 6 is a plot of direct current breakdown voltage vs. number of surges for a device of the present invention and for comparative convention devices.

Reliability testing was also performed on a gas discharge device comprising a pair of spaced parallel electrodes comprising the previously mentioned molybdenum disk provided with an adhesion promoting layer of iron and a coating of single-walled carbon nanotubes. The sealed chamber of the device was filled with 15 torr argon, with neon added, and with a 1 mm separation distance defined between the electrodes. For purposes of comparison, a first and second commercially available gas discharge tube were also measured. The commercially available gas discharge tubes had the same electrode-electrode separation distance. FIG. 6 illustrates the direct current breakdown voltage measured over 100 voltage surges for the nanotube-based gas discharge device of the present invention, as well as the comparative commercially available gas discharge devices. As illustrated in FIG. 6, the nanotube-based gas discharge device of the present invention had a breakdown voltage of 448.5V, and a standard deviation of 4.58V after 100 surges. The commercially available gas discharge device from the first manufacturer had a higher breakdown voltage of 594V with a greater standard deviation of 20V, while the gas discharge device from the second manufacturer also had a higher direct current breakdown voltage of 563V with a greater standard deviation of 93V. Thus, it is apparent that the breakdown reliability of the nanotube-based gas discharge device of the present invention is 4–20 times better, and the necessary breakdown voltage is approximately 30% lower, when compared with the two commercially available gas discharge devices.

Figure 7:
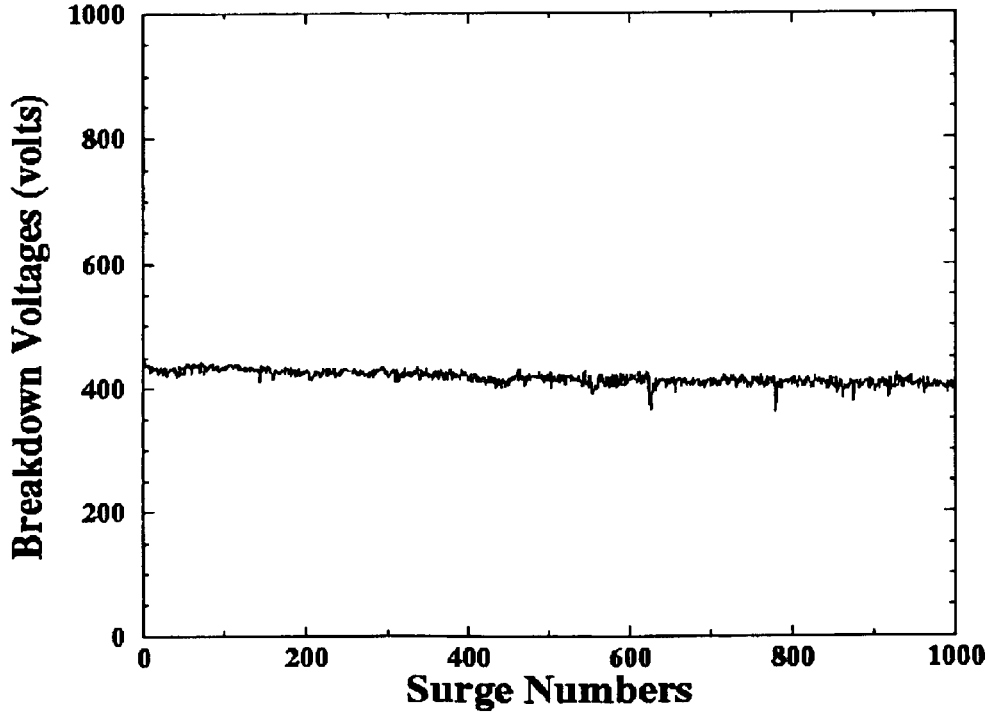
FIG. 7 is a plot of direct current breakdown voltage vs. number of surges for a device according to the present invention.

FIG. 7 is a plot of direct current breakdown voltages measured over 1000 surges for the same gas discharge device of the present invention described above in connection with the measurements taken and illustrated in FIG. 6. As illustrated in FIG. 7, the breakdown voltage decreased gradually with an increasing number of surges. This is a desirable property, since the amount of over voltage in a circuit in which the gas discharge device may be employed, is reduced over time, thereby improving the protection of other circuit components from an over voltage condition. After 1000 surges, the direct current breakdown voltage of the gas discharge device of the present invention became approximately 400V. Thus, the gas discharge device constructed according to the principles of the present invention possesses an improved reliability when compared with conventional devices.

This gradual decrease in the breakdown voltage is a desirable property of the present invention. Typically, conventional gas discharge devices exhibit the opposite behavior. Namely, the breakdown voltage usually increases over time, thereby adversely effecting the reliability of the device. By contrast, the present invention, by exhibiting a decreased breakdown voltage over time, providing important advantages in terms of reliability of the device, and its ability to protect associated circuit components from over voltages.

Measurements were also taken for unannealed electrodes. After 1000 surges, the nanotube-based electrodes were removed from the devices and were examined by a scanning electron microscope. The unannealed electrodes were depleted of the single walled carbon nanotubes, while the majority of nanotubes remained intact on the annealed electrodes. The degradation of unannealed electrodes is believed to be caused by the pulling off of single walled carbon nanotubes under the high electrical fields present in such devices. Thus, it appears that by providing an adhesion-promoting layer, and annealing the coated electrode, the present invention remains stable and robust even after being exposed repeatedly to high electrical fields.

To summarize the above, the collected data clearly shows the gas discharge devices constructed according to the principles of the present invention have significantly improved performance in terms of direct current breakdown voltage and reliability when compared to similarly constructed commercially available gas discharge devices. The lower required breakdown voltage, and a 4–20 times reduction in breakdown voltage fluctuations make the gas discharge devices of the present invention attractive over voltage protection units.

Thus, it is within the scope of the present invention to provide a circuit, comprising at least one gas discharge device formed according to the principles of the present invention.

Figure 8:
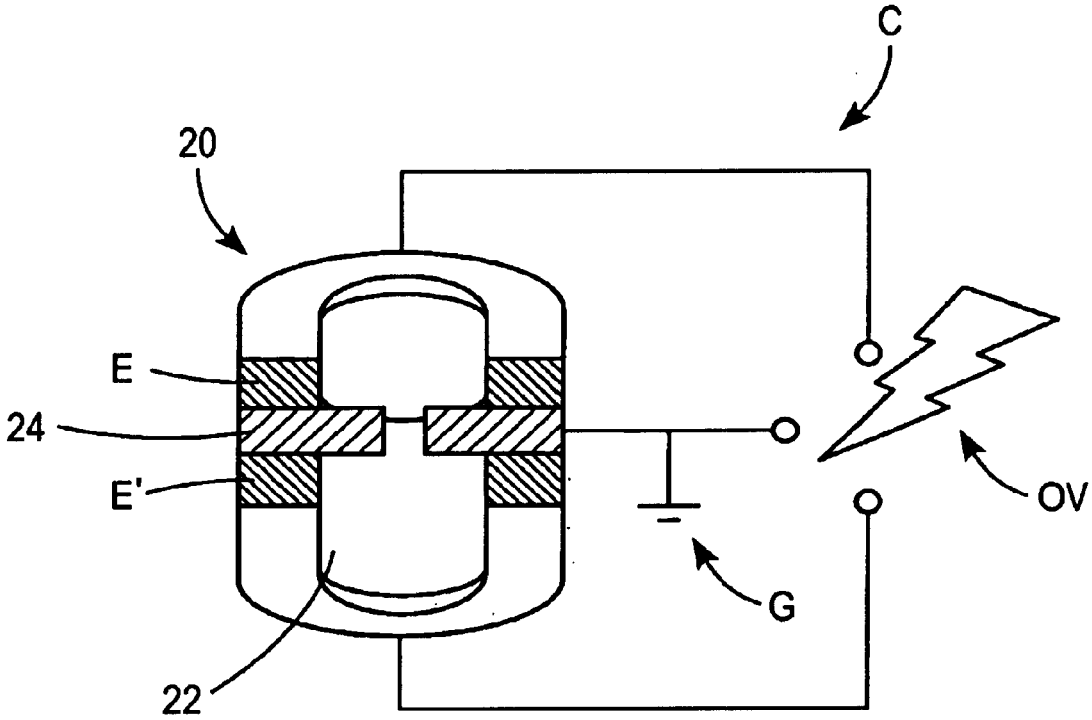
FIG. 8 is a schematic illustration of an improved circuit formed according to the principles of the present invention.

Such a circuit C is schematically illustrated in FIG. 8. As illustrated in FIG. 8, upon introduction of an overvoltage OV, the electrodes E, E' field emit electrons sufficient to cause a plasma breakdown within the chamber 22 of the gas discharge device 20. This breakdown causes the gas discharge device 20 to become conductive thereby defining a conductive path for the overvoltage OV leading to the ground G. Thus, the overvoltage OV can be directed to the ground, and away from other sensitive components of the circuit (not shown).

Figure 9:
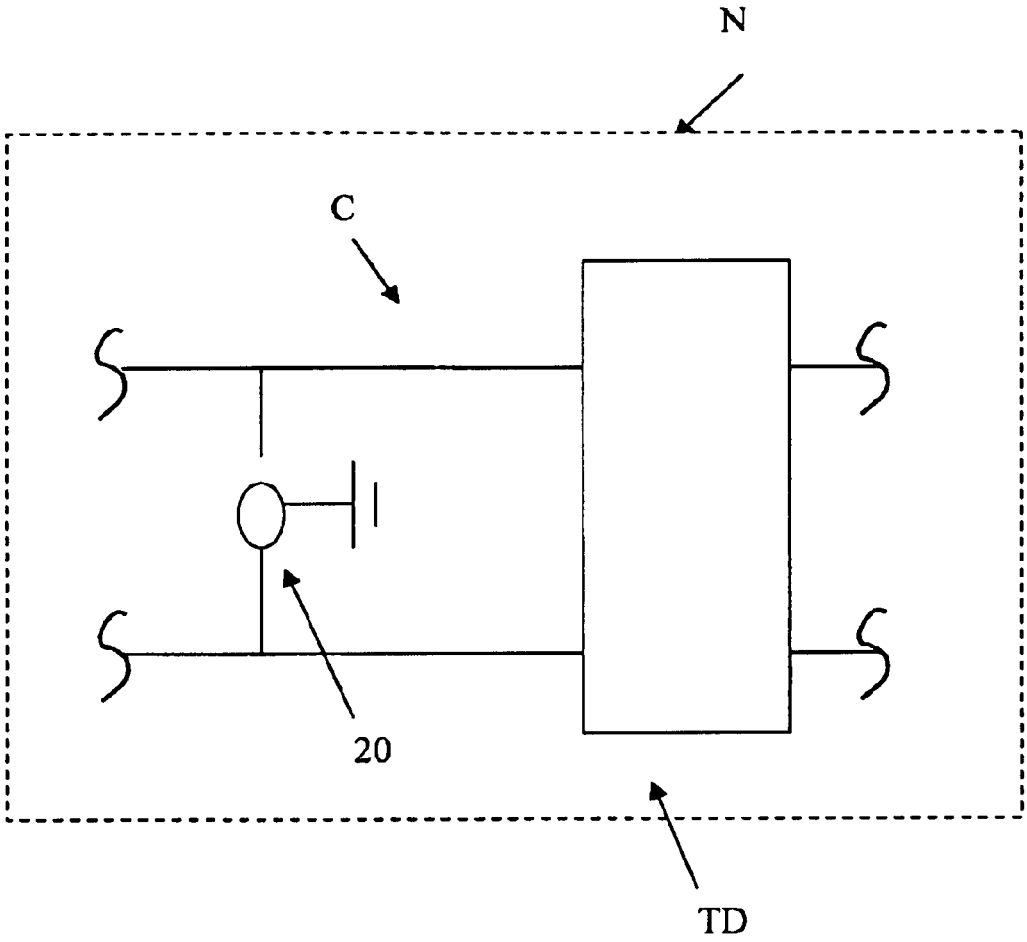
FIG. 9 is a schematic illustration of a telecommunications network according to the invention.

Further, according to the principles of the present invention, as illustrated in FIG. 9, an improved telecommunications network N can be provided. Examples of suitable telecommunications networks, incorporating a gas discharge protection device 20 constructed according to the principles of the present invention include telecommunication device TD such as asymmetric digital subscriber lines (ADSL) and high-bit-rate digital subscriber lines (HDSL).

Figure 10:
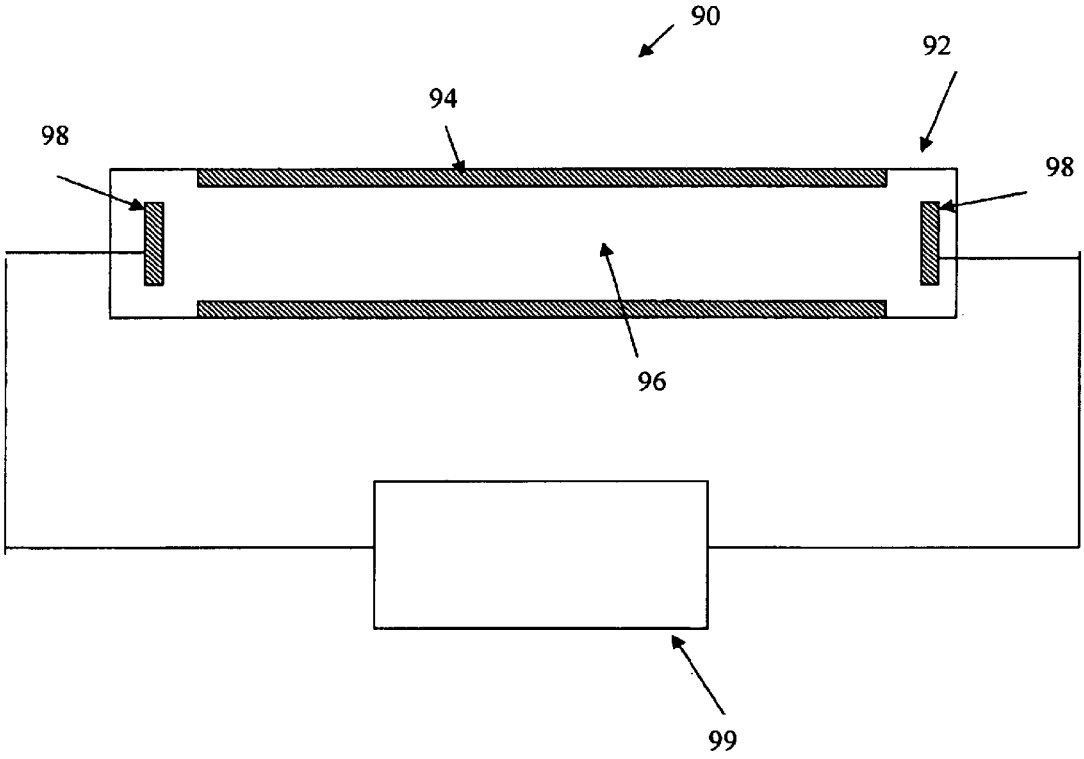
FIG. 10 is a schematic illustration of a lighting device of the present invention.

The nanotube-based electrodes according to the present invention, by virtue of their improved properties, such as reduced variance and mean breakdown voltage, increased breakdown reliability over time, smaller electron emission turn-on requirements, stable electron emissions capable of high current density, and decreased reliance upon precise small separation distances when incorporated into certain devices, render them especially suited in other applications requiring robust and reliable ignition. For instance, electrodes constructed according to the principles of the present invention may be incorporated in a lighting device, such as high intensity lighting. FIG. 10 is a schematic illustration of an exemplary lighting device in which one or more electrodes constructed according to the principles of the present invention may be incorporated. FIG. 10 illustrates lighting device 90 which generally comprises a filled glass tube 92 which includes a phosphor coating 94 disposed on an inner surface thereof. Chamber 96 defined within the glass tube 92 contains a suitable material such as mercury and one or more inert gas. One or more electrodes 98 formed according to the principles of the present invention, as set forth previously, are provided and are in communication with a power source 99. The power source 99 causes the electrodes 98 to field emit electrons, thereby exciting the materials and phosphor coating within the glass tube 92 in a manner familiar to those in the art.

Figure 11:
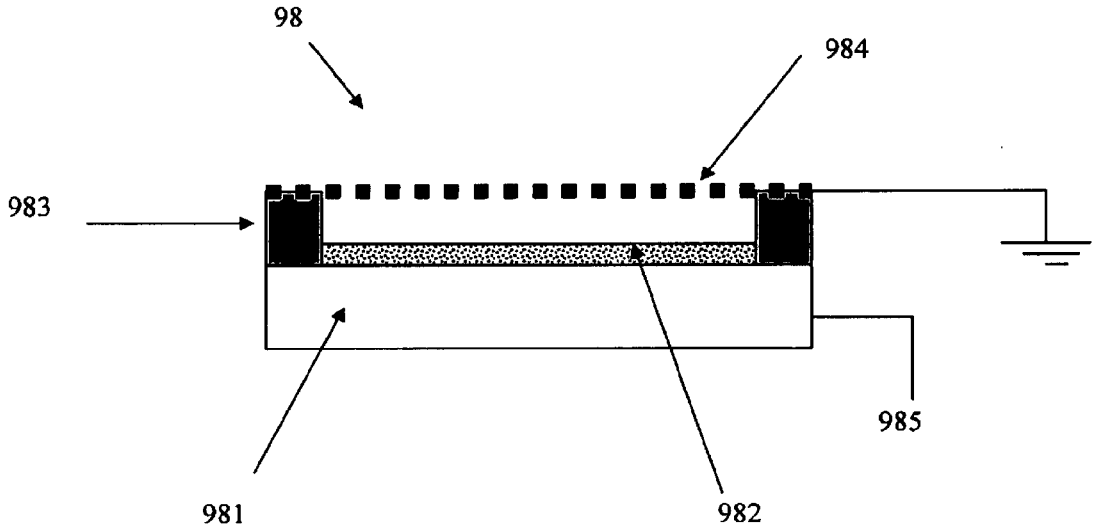
FIG. 11 is an enlarged view of the electrode of FIG. 9.

FIG. 11 is an enlarged schematic illustration of the electrode 98 of the lighting device 90. As illustrated in FIG. 11, electrode 98 generally comprises a substrate 981 upon which coating 982 is applied. As previously described, coating 982 can comprise a nanostructure-containing material according to the present invention, as well as an adhesion promoting layer. According to a preferred embodiment, the nanostructure-containing material comprises single walled carbon nanotubes. An electrical insulator 983 is provided on the substrate 981, and includes a gate structure 984 which is in communication with the ground. By virtue of the beneficial properties of the electrodes of the present invention, the need for ballast-type igniters can be eliminated.

Although the present invention has been described in connection with the preferred embodiments thereof, it will be appreciated by those skilled in the art that editions, deletions, modifications and substitutions not specifically described above may be made without departure from the spirit and scope of the invention as defined in the appended claims.

What is claimed is:

1. A gas discharge device comprising a sealed chamber containing at least one noble gas and at least one electrode, the electrode comprising a substrate, carbon nanotubes and an adhesion promoting material to promote adhesion of the carbon nanotubes to the substrate, wherein the adhesion promoting material comprises at least one of a carbon-dissolving material, a carbide-forming material, and a material selected from the group consisting of aluminum, tin, cadmium, zinc and bismuth.

2. The gas discharge device of claim 1, wherein the electrode comprises pre-formed carbon nanotubes deposited after formation on at least a portion of a surface of the electrode.

3. The gas discharge device of claim 2, wherein the carbon nanotubes are deposited after formation on at least the portion of the surface of the electrode by one of a casting, a printing, a spraying, a spin coating, and an electrophoresis deposition process.

4. The gas discharge device of claim 2, wherein the carbon nanotubes are single-walled carbon nanotubes.

5. The gas discharge device of claim 2, wherein a thickness of the adhesion promoting layer is 50 nm.

6. The gas discharge device of claim 2, wherein the deposited carbon nanotubes are annealed.

7. The gas discharge device of claim 1, wherein the carbon nanotubes are single-walled carbon nanotubes.

8. The gas discharge device of claim 1, wherein a thickness of the adhesion promoting layer is 50 nm.

9. The gas discharge device of claim 1, wherein the deposited carbon nanotubes are annealed.

10. A lighting device comprising a sealed chamber containing an excitable gas, a phosphor coated surface, and at least one electrode, the electrode comprising a substrate, carbon nanotubes and an adhesion promoting material to promote adhesion of the carbon nanotubes to the substrate, wherein the adhesion promoting material comprises at least one of a carbon-dissolving material, a carbide-forming material, and a material selected from the group consisting of aluminum, tin, cadmium, zinc and bismuth.

11. The lighting device of claim 10, wherein the electrode comprises pre-formed carbon nanotubes deposited after formation on at least a portion of a surface of the electrode.

12. The lighting device of claim 11, wherein the carbon nanotubes are deposited after formation by one of a casting, a printing, a spraying, a spin coating, and an electrophoresis deposition process.

13. The gas discharge device of claim 11, wherein the carbon nanotubes are single-walled carbon nanotubes.

14. The gas discharge device of claim 11, wherein a thickness of the adhesion promoting layer is 50 nm.

15. The gas discharge device of claim 11, wherein the deposited carbon nanotubes are annealed.

16. The gas discharge device of claim 10, wherein the carbon nanotubes are single-walled carbon nanotubes.

17. The gas discharge device of claim 10, wherein a thickness of the adhesion promoting layer is 50 nm.

18. The gas discharge device of claim 10, wherein the deposited carbon nanotubes are annealed.

* * * * *